US008235712B1

(12) United States Patent
Lewis

(10) Patent No.: US 8,235,712 B1
(45) Date of Patent: Aug. 7, 2012

(54) HIGH TEMPERATURE HEAT-SHRINK STEAM TUNNEL

(76) Inventor: Graham Louis Lewis, Vaudreuil-Dorion (CA)

( * ) Notice: Subject to any disclaimer, the term of this patent is extended or adjusted under 35 U.S.C. 154(b) by 882 days.

(21) Appl. No.: 12/351,109

(22) Filed: Jan. 9, 2009

Related U.S. Application Data

(63) Continuation-in-part of application No. 11/483,572, filed on Jul. 10, 2006, now abandoned.

(51) Int. Cl.
*B65B 53/02* (2006.01)
*B65B 53/06* (2006.01)

(52) U.S. Cl. ..... 432/121; 432/143; 432/152; 53/557

(58) Field of Classification Search ..... 432/121, 432/128, 133, 143, 152, 155; 53/556, 557
See application file for complete search history.

(56) References Cited

U.S. PATENT DOCUMENTS 2,829,791 A * 4/1958 Berst ..... 53/415
3,678,244 A * 7/1972 Worline ..... 219/388
3,750,303 A 8/1973 Gates et al.
3,756,769 A * 9/1973 Richardson et al. ..... 432/142
4,738,082 A * 4/1988 Saitoh ..... 53/557
5,062,217 A * 11/1991 Tolson ..... 34/443
5,189,948 A * 3/1993 Liebermann ..... 99/443 C
5,400,570 A * 3/1995 Bennett ..... 53/442
6,576,872 B2 * 6/2003 Bertero ..... 219/388
6,958,178 B2 10/2005 Hayakawa et al.

* cited by examiner

*Primary Examiner* — Gregory A Wilson
(74) *Attorney, Agent, or Firm* — Richard L. Marsh

(57) ABSTRACT

A device intended to assist in the accurate and controlled shrinkage of thermo-shrinkable container-jacketing material. Said device producing at least an elevated temperature in a heated processing zone. Heat energy available in said heated processing zone primarily derived from a first heat source, preferably pressurized steam. Said first heat source steam exhibiting preferred characteristics related to the controlled shrinking of thermo-shrinkable materials. A second heat source, other than steam, acting in cooperative relationship with said first heat source steam, delaying the decay of one or more preferred characteristics of said first heat source steam. Said first heat source steam, urging said heat-shrinkable materials to shrink, substantially conforming to receiving containers in a preferred manner along one or more axis.

12 Claims, 6 Drawing Sheets

HIGH TEMPERATURE HEAT-SHRINK STEAM TUNNEL

CROSS-REFERENCE TO RELATED APPLICATIONS

This application is a continuation-in-part application of Applicant's co-pending application Ser. No. 11/483,572 filed 10 Jul. 2006, now abandoned.

BACKGROUND OF THE INVENTION

1. Field of the Invention

Heated processing zones that rely substantially on steam have a variety of industrial and commercial applications. The use of steam as a heating source provides a source of high thermal mass heat due to the enthalpy of vaporization of steam. Once the steam condenses, a source of moisture also becomes available. Although heated processing zones can be used to impart desired moisture content to items in the tunnel, such as wood and tobacco, the heated processing zone described herein is intended to impart heat energy to shrink thermo-shrinkable materials that have been pre-applied to containers which then pass through the heat tunnel.

2. Prior Art Statement

The use of shrinkable plastic film for wrapping and over wrapping consumer or industrial products is well known. In addition to acting as a tamper evident indication, such shrinkable films may also be used to fasten two or more articles together. Continuous flattened tubes of thermo-shrinkable material intended to be sectioned into sleeves and place on containers are commonly referred to as shrink band. Shrink band may be constructed of any suitable transparent or opaque film which can be adequately shrunk onto a container in order to produce a form fitting jacket.

The majority of applications within the packaging industry rely on thermo-shrinkable plastic film. The preferred materials are polyvinylchloride (PVC) and polyethylene terepthtalate, (PET). These plastic films typically exhibit shrinkages of approximately 50% along a first axis and approximately 10% along an axis 90 degrees to the first axis. A variation of PET referred to as PTEG, and oriented polystyrene (OPS), have been formulated to provide additional shrinkage up to approximately 70% along at least one axis. The aforementioned shrink band materials tend to shrink at temperatures ranging from approximately 200 degrees Fahrenheit to approximately 350 degrees Fahrenheit. Shrink band materials exhibiting shrinking temperatures outside this range may exist for other applications. Shrink band is formulated to effect a required reduction in geometry in less time than it takes to have the product be compromised from the effects of the shrink-inducing heat energy.

As previously mentioned, the term generally used in the packaging industry for this group of materials is shrink band. The cut sections of shrink band material are referred to as sleeves. Where the coverage of the container is substantial, the sleeves are referred to as body bands or sleeves. If the coverage of the container is substantially around the upper portion of the container, the sleeves are referred to as neck bands. In either of the above mentioned cases, a portion of the shrink band material may or may not cover or may partially cover a cap or seal at the filling or discharge opening of the container.

The shrink band material may be in direct contact with the enclosed product or it may be used as an over-wrap to another containment scheme for the product. The shrink band may also be part of a securing scheme that is intended to substantially maintain product integrity and to assist in preventing the product being intentionally compromised or accidently compromised. Where required, the band material may also contribute to the prevention of product exposure or overexposure to undesired elements including but not limited to air, dust, germs and various frequencies of the electromagnetic spectrum such as visible light and ultraviolet radiation.

The shrink band material may be pre-printed with graphic data, human readable data or machine readable data identifying the enclosed product and including information pertaining to said product and its proper usage.

A further application of the thermo-shrinkable process would include items placed over a section of suitable support material such as cardboard or pre-printed cardboard, or other suitable material that may or may not be pre-printed. The pre-printed material may include graphic data, human readable data or machine readable data.

The thermo-sensitive material is shrunk over the product and said suitable support material. The aforementioned process would typically be used instead of "blister" style packaging where it was desirable to restrict free movement of the contained product or to reduce the ease with which the product could be intentionally or accidently removed from the packaging.

Pre-printed thermo-sensitive materials can replace the need for labels. The pre-printed materials may also perform a decorative function. Based on the type of thermo-shrinkable material being shrunk, the device featuring the heated processing zone, often referred to as a heat tunnel, is constructed in varying lengths accommodating the required heating time exposure of the thermo-shrinkable material. The number of shrink events required per minute and the conveyor speed may affect the time the thermo-shrinkable material is actually inside the heat tunnel, and thus also contributes to the working length of the tunnel.

Typical heat sources of heat tunnels include electric heating elements, infrared emitters and steam sources. Each of these aforementioned systems may feature preferred characteristics particular to their application. Where containers to be jacketed exhibit novel geometries, the preferred advantages of steam-based heating are particularly advantageous at producing predictable and controlled shrinkage of the thermo-shrinkable material.

U.S. Pat. No. 6,958,178, Hayakawa, et al., granted Oct. 25, 2005, 'Heat-shrinkable polyester film roll,' extols the advantages of steam a as heat source over that of ordinary hot air when used to heat shrink band material. In the 'background art' section, we note:

"(I)ncidentally, for wrapping bottles by heat-shrinkable films, the heat-shrinkable films are hitherto first printed (in printing step) and then processed into the shape suitable for loading onto the containers such as labels (tubular labels), tubes, bags, and the like. Subsequently, these processed films are loaded onto the bottles, which are transferred on a conveyor belt through a heating tunnel (shrinkage tunnel), and the films are tightly bound to the containers by heat shrinkage. Steam tunnels, wherein the films are allowed to shrink by blowing steam, and hot-air tunnels, wherein the films are shrunk by blowing heated air, and the like are commonly used as the shrinkage tunnels.

"The steam tunnels are generally better in heat transfer efficiency than the hot-air tunnels, and thus allow more uniform heat shrinkage of such labels and provide shrunk products better in appearance. However, even if the steam tunnel is employed, the heat-shrinkable polyester films are often not quite satisfactory from the viewpoint of product appearance property after heat shrinkage, compared to polyvinyl chloride and polystyrene films.

"Further, the hot-air tunnel has a tendency to cause large variation in temperature during heat shrinkage than the steam tunnel. Thus, when polyester films, lower in the product appearance property after heat shrinkage than polyvinyl chloride and polystyrene films, are heat-shrunk therein, the resulting films often have whitening due to shrinkage, shrinkage shading, crinkling, deformation, and the like, and especially a problem in appearance due to whitening."

It becomes readily apparent from reading of Hayakawa, et al., that appearance is a critical issue with heat-shrinkable films, especially in hot air tunnels but appearance is not entirely satisfied when passed through a saturated steam tunnel. Thus, higher heat transfer rates are required to ensure satisfactory appearance of the heat-shrunk packaging material.

U.S. Pat. No. 3,750,303, Gates, et al., granted Aug. 7, 1973, 'Steam tunnels for treating logs and methods of treatment,' discloses a multi-zone steam tunnel where "(T)he steam supplied to all zones is modulated for each zone by a temperature regulating valve, each zone having its own valve, which is controlled by an electrical temperature sensing device that operates in accordance with the temperature of the condensate leaving the respective zones, and the atmospheric temperature in the respective zones. While each zone has a separate temperature control valve, steam for all four zones of each tunnel is preferably supplied from a single source."

This patent introduces steam and condensate into a tunnel in an attempt to maintain a particular humidity as logs are exposed to the combined effects of the steam and the condensate. In this configuration, the steam would quickly lose its heat energy as it is absorbed to warm the simultaneously injected condensate.

Neither U.S. Pat. No. 6,958,178, Hayakawa, et al., nor U.S. Pat. No. 3,750,303, Gates, et al., disclose, suggest or infer the use of a second heat source acting cooperatively with a preferred first heat source to slow the loss of the preferred high thermal mass steam. In addition, neither teach the use of superheated steam for shrinking shrink band material around products or product containers.

Worline, U.S. Pat. No. 3,678,244, issued on 18 Jul. 1972 teaches an apparatus for shrinking low shrink films such as Saran or Polyethylene film around packaged food products using hot water maintained in a range from 190° F. to 210° F. Worline teaches a plurality of atomizing nozzles positioned in the tunnel over the grid or rod belt, and as shown clearly in the drawings, the nozzles are in a single plane and disposed well above the grid. Additionally, Worline employs nine 1.35 Kw pan heaters and nine 1.35 Kw convection heaters to maintain the hot water in the specified temperature range and more specifically "... to form a dense hot vapor or steam cloud that will completely surround the product ..." A dense hot vapor or steam cloud is layman's language for saturated steam containing water at temperatures at or below the boiling point of water. Hayakawa, et al, teaches that higher temperature shrink films such as polyester, polyvinyl chloride or polystyrene, when exposed to water, are subject to whitening due to shrinkage, shrinkage shading, crinkling, deformation in low temperature shrinkage tunnels and therefore atomization of water, implying employment of water droplets as taught by Worline, may be acceptable for low temperature shrink films, but is not acceptable for high temperature films used in controlled wrapping of products or product containers and thus will result in poor product appearance when used for shrink band on product containers or directly upon products such as card stock. The 18 heaters of Worline are sufficient to maintain the specified temperature range, however, are insufficient to raise the temperature of the water to boiling at 212° F. and thus are also incapable of producing any higher temperature in the presence of the hot water spray. Though Worline has a shut off thermostat set at 240° F., it is only functional when water flow has stopped. Obviously therefore, Worline does not teach use of higher temperature steam, and in particular, does not teach use of superheated steam for shrink band.

U.S. Pat. No. 6,576,872 B2, issued on 10 Jun. 1003 to Bertero, teaches use of superheated steam for vulcanization of pre-formed elastomeric articles, particularly tubes, such as radiator hoses. Bertero teaches that all the steam is superheated as "(T)he re-circulation circuit ... is provided with a set of electrical resistors ... to superheat the steam before it is admitted into the curing chamber." (Emphasis added) Thus, in Bertero, all the steam is at the same temperature when it enters the chamber as the steam generator and the superheating re-circulation chamber are both external of the apparatus. Bertero does not teach maintaining the temperature of the superheated steam within the chamber by employing heaters in the chamber and as Bertero uses only superheated steam, Bertero also does not teach maintaining the temperature of saturated steam within the chamber but rather teaches elevating saturated steam to superheated steam externally of the chamber. Bertero does not teach the employment of electrical (infrared) heating elements within the chamber to not only transfer the heat from steam but also heat in the infrared spectrum. It is readily apparent then that condensation occurs rapidly in both Worline and Bertero and thus the quality issues discussed by Hayakawa, et al., are present in both devices.

BRIEF SUMMARY OF THE INVENTION

In general, there exists a need in the packaging industry to impart a controlled and accurate shrinkage of band material producing a post shrunk jacket substantially conforming to the shape of the container or product by admitting either saturated or superheated steam through a manifold disposed at least partially at an obtuse angle to the conveyor and to the longitudinal axis of the chamber to establish a temperature gradient wherein the temperature gradient is maintained or augmented by a second heat source. If the shrinking process does not proceed as required, undesirable post shrinking issues, such as bubbles, overlaps and creases in the post shrunk material may result.

Where the container or product to be covered is substantially symmetrical and parallel about its vertical axis, the techniques required for shrinking the thermo-shrinkable sleeves are well known to those skilled in the art. However, where the container features novel geometries, or when a thermo-shrinkable sleeve features graphic data, human readable data or machine readable data, the ability to shrink the thermo-shrinkable shrink band material in the preferred manner without distortion of the pre-printed data can be challenging. Therefore, it is an object of this invention to provide a second heat source disposed within a heat-shrinking tunnel to establish and ensure a controlled temperature gradient thus preventing distortion band sleeves carrying pre-printed data.

Devices referred to as 'band tackers' are small focused heat sources that quickly and initially heat and shrink a relatively small portion of the thermo-shrinkable band material in an attempt to initially anchor the thermo-shrinkable material to the receiving container. This tacking process positions the thermo-shrinkable material in a preferred manner for further exposure to the effects of the heated environment disposed within the heated processing zone. The inclusion of strategically placed fans or blowers may assist in a circulation of air within the heated processing zone. In some applications, a variety of means may be included to also urge movement of air substantially exterior of the heated processing zone to enter the heated processing zone. Therefore, it is an object of this invention to provide a second heat source disposed within a heat-shrinking tunnel to function as a band tacker to quickly shrink a portion of a shrink band sleeve about a lower portion of a container or product passing through the shrink tunnel.

It is an object of this invention to provide a method of retarding loss of heat energy of the steam such that the higher thermal mass transparent steam has more time to surround the shrink band and effect a controlled shrinkage of the shrink band while the heat energy contained within the steam is still relatively high.

While no process can guarantee consistently perfect shrinkage of thermo-shrinkable material, where applicable, it has been found by the inventor hereof, that the use of pressurized steam reduces significantly the number of undesirable shrink defects.

It is therefore desired to effect exposure of the thermo-shrinkable material to the maximum available heat energy substantially disposed inherent within the transparent steam.

It is an object of this invention to provide a heat tunnel design which overcomes the shortcomings of prior art devices by delaying the loss of heat energy from the transparent steam.

It is desired to effect exposure of thermo-shrinkable materials to the maximum available heat energy substantially disposed within the transparent steam.

The present invention relates to a device and method to retard the loss of heat energy of the relatively high thermal mass transparent steam such that the transparent steam has more time to surround the thermo-shrinkable band and effect a preferred shrinkage of said band while the heat energy contained within the steam is still relatively high.

It is an object of this invention to provide a heat tunnel design which overcomes the shortcomings of the previous art by delaying the loss of heat energy from the transparent steam.

A further object of the present invention is to provide a steam-based heating tunnel that overcomes or alleviates some of the known deficiencies associated with prior art steam-based, or more accurately water vapor based, heating tunnels.

A further object of the present invention is to provide a device where a second heat source, other than steam, substantially and advantageously retards the decay of one or more preferred characteristics of a first heat source derived from steam.

A further object of the present invention is to provide a reduced decay heat source that is in communication with temperature sensitive material pre-placed on a container or object intended to undergo exposure to heat energy for the purposes of shrinking the temperature sensitive material.

A further object of the present invention is to provide a heated processing zone that incorporates a plurality of heat sources acting cooperatively to produce a preferred shrinkage of thermo-shrinkable film.

A further object of the present invention is to provide a heat tunnel with a reduced volume steam requirement performing a preferred shrinking of thermo-shrinkable material.

A further object of the present invention is to provide a heat tunnel that is able to perform a preferred shrinkage of thermo-shrinkable material in a reduced time period which could minimize unwanted heat exposure to and heat absorption by the product.

A further object of the present invention is to provide a steam tunnel featuring a reduced physical length to effect a preferred shrink of thermo-shrinkable material.

A further application of the thermo-shrinkable process would include items placed over a section of suitable support material such as cardboard or pre-printed cardboard, or other suitable material that may or may not be pre-printed. The pre-printed material may include graphic data, human readable data or machine readable data.

The thermo-sensitive material is shrunk over the product and said suitable support material. The aforementioned process would typically be used instead of "blister" style packaging where it was desirable to restrict free movement of the contained product or to reduce the ease with which the product could be intentionally or accidently removed from the packaging.

This 'Brief summary of the Invention' does not purport to define the invention. The invention is defined by the claims.

BRIEF DESCRIPTION OF THE SEVERAL VIEWS OF THE DRAWING

Features of the present invention will become apparent from the following detailed description considered in connection with the accompanying drawings. It is to be understood, however, that the drawings are provided for purposes of illustration only and not as a definition of the boundaries of the invention, for which reference should be made to the appending claims.

DETAILED DESCRIPTION OF THE INVENTION

Figure 1:
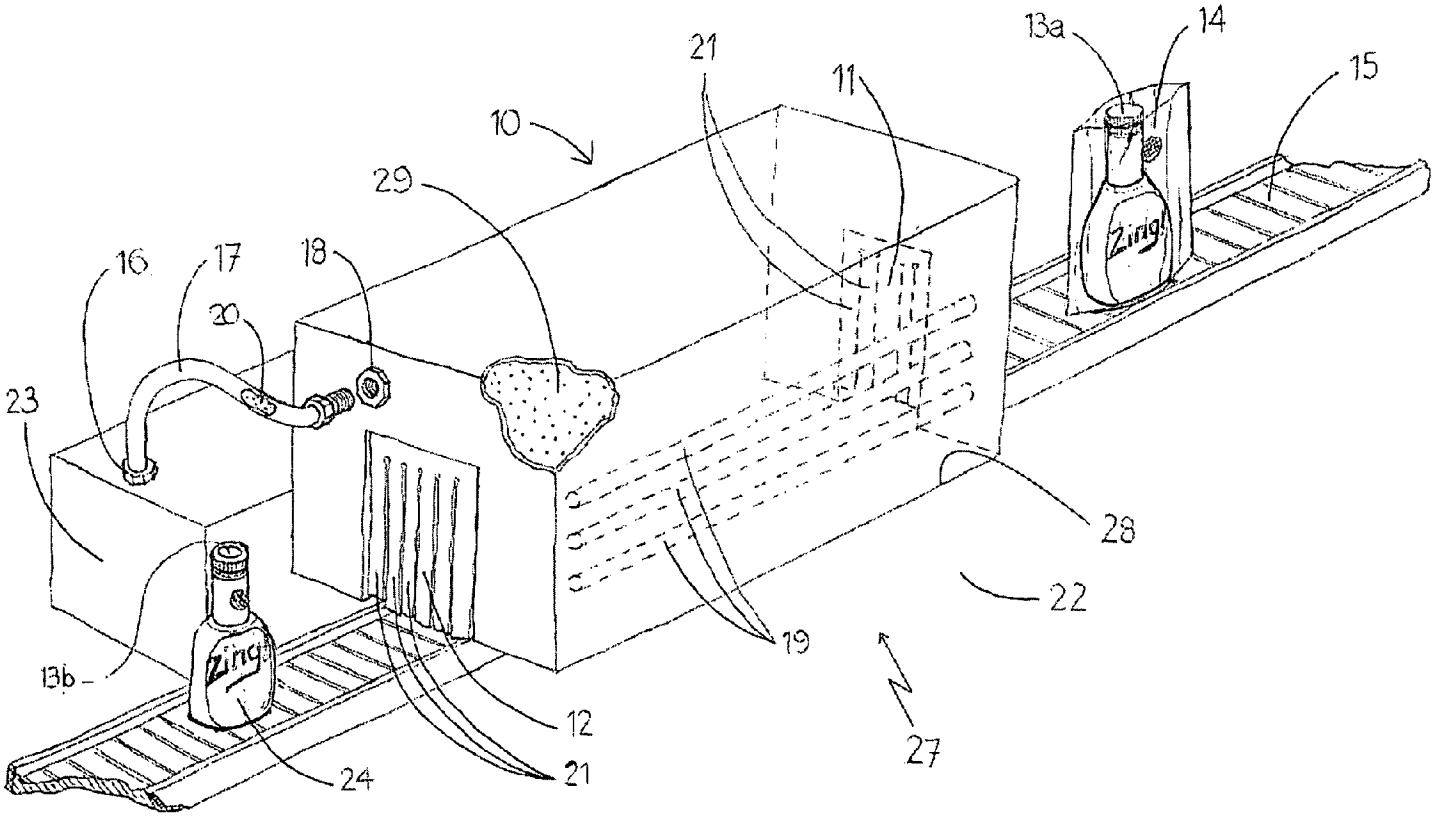
FIG. 1 illustrates a schematic perspective view of the general exterior of the device in accordance with the present invention.

Detailed descriptions of preferred embodiments of the invention are provided herein. In a preferred embodiment, FIG. 1 illustrates a steam tunnel 10, in accordance with the present invention. In a particular, non-limiting example of implementation, a conveyor 15 transporting items 13 featuring pre-placed thermo-shrinkable sleeves 14 enters a heated processing zone 27 through a first opening 11 and then after thermo-shrinkable sleeves 14 are shrunk within heated processing zone 27, containers 13*b* carrying post-shrunk sleeves 14 exit through a second opening 12 of heated processing zone 27. In certain applications there may be a requirement for the objects 13 intended to be heated to enter and exit the heated processing zone 27 through the same opening 11,12. Such devices are often referred to as heating ovens. Shrinkage of thermo-shrinkable sleeves 14 takes place when the pre-placed thermo-shrinkable sleeve material is exposed to the heat energy disposed substantially within the heated processing zone 27.

The first open end 11 of heated processing zone 27 and second end 12 of the heated processing zone 27 as well as the bottom 28 of heated processing zone 27 are substantially open to the ambient environmental conditions substantially exterior of the heated processing zone 27. Losses of heat energy from the heated processing zone 27 include at least the aforementioned heated processing zone openings 11, 12.

Preferably, pliable elastomeric curtain segments 21 partially and temporarily obstructing first 11 and second 12 heated processing zone openings to reduce heat energy loss to the temperature and humidity conditions exterior of the heated processing zone 27. The bottom of the heated processing zone 27 may or may not also feature a pliable elastomeric material reducing heat energy loss from the bottom of the heated processing zone 27.

When steam is introduced as a heat source, it is usually produced exterior of heat tunnel 10 and at a pressure above standard 15 PSIA room pressure, in order to obtain steam temperatures higher than sea level boiling point of water. The steam must be maintained under pressure to preserve its desirable working characteristics until required for eventual introduction substantially within the heating tunnel 10.

In the above configuration, the pressurized steam 20 is transferred through a connecting pipe such as flexible conduit 17 from a pressurized heating chamber of a steam generator 23, steam generator 23 generally exterior of the heating tunnel 10. Steam 20 under pressure is injected into heat tunnel 10 as jets through one or more discharge orifices 31. It must be noted that different plastic shrink materials have different shrinkage rates and product surrounded by thermo-shrinkable sleeves 14 may thus require different amounts of heat energy to effect proper shrinkage. Therefore, the aperture of orifices 31 is selected to effect a controlled pressure drop in heat tunnel 10 to control the heat energy of the pressurized steam used within the heat tunnel 10. This first significant temperature drop of the steam exiting discharge orifices 31 continues until such time as the initially superheated steam under pressure has expended sufficient heat energy as to finally become water vapour as saturated steam. Then, after condensation occurs, most of the amount of useful heat energy left in the steam has diminished sufficiently that it is not generally suitable for heat shrinking purposes. For example 1 pound of 322° F. saturated steam at 80 PSIG (approx) has 1186 Btu of available energy per pound of steam. Once the Steam has given up its Enthalpy of Vaporization and is in the liquid form as water vapor, and was now to cool from 212° F. to say 192° F. only a further 20 BTU of heat is available. Therefore the instant invention could provide 1186 plus 20 BTU of energy per pound of steam cooperatively with the infrared (or other) electrical heating elements 19, to shrink the high temperature shrink sleeves 14, 25, whereas the 18-1.35 KW heaters of one prior art device will take one hour to convert the designed water input of 5-6 gallons per hour to steam at 212° F. under ideal conditions, leaving only 20 BTU per pound of steam as the water vapor cools from 212° F. to 192° F. in a similar circumstance, little, if any energy to shrink higher temperature shrink bands. In the instant invention, second heating elements 19 are effectively used to maintain specific temperatures at various elevations above conveyor 15 in order to properly shrink shrink bands 14, 25. Second heating elements 19 in steam-heated processing zone are selected from the group consisting of infrared heaters, electrical strip heaters, radiant heaters, hot air blowers, high frequency electromagnetic devices, high frequency sonic discharge devices and combinations of the above, though electrical strip heaters are preferred. Thus, second heat source 19 augments the temperature of steam discharged from steam manifolds 30 to maintain the temperature thereof and thus delays onset of condensation by maintaining the temperature of the steam at or above a condensation temperature and reduction of heat energy from losses and absorption is slowed to increase the time available for the maximum heat energy contained in the steam to be imparted to the thermo-shrinkable material 14, 25. By maintaining steam at or above condensation temperatures, the thermal mass of the transparent, that is superheated steam, aids the preferred shrinking of the thermo-shrinkable material. Obviously, if the heat energy of the steam heating system is not maintained at or above condensation temperatures, an additional volume of steam or higher temperature steam would be required at the increased expense of larger steam generators which would require increased power.

At sea level, approximately 15 PSIA, and absent a containing enclosure, the maximum possible temperature of water is 212 degrees F. At pressures in excess of 15 PSIA, steam can be heated to temperatures in excess of 212 degrees Fahrenheit wherein the steam is generally referred to as superheated steam, or transparent or invisible steam. When this relatively high temperature steam is permitted to expand, the temperature of the steam drops and the invisible steam eventually undergoes a phase change from the superheated state to a saturated state and finally to condensate, i.e. water droplets. As the invisible steam goes thru the phase change, there is a slight pause to the onset of visible water vapour as the latent heat of vaporization is liberated without lowering the temperature of the steam. The thermodynamic definition of heat transfer defines the amount of heat given up by a heated substance as the enthalpy of condensation (or heat of condensation). The enthalpy of condensation is numerically equal to the enthalpy of vaporization, expressed here in Btu per pound, but enthalpy of condensation has the opposite sign. In the apparatus of the instant invention, steam approaching 350° F. is employed to advantage for thermo-shrinkable sleeves 14. It has been found by the inventor hereof that consistent quality of shrinkage of materials at or near the boiling point of water is difficult to achieve, however, by elevating steam well above the boiling point of water, and maintaining the temperature thereof, consistent shrinkage is easily achieved thus resulting in greater product flow and enhanced product appearance. For instance, in the inventive apparatus, temperatures in the tunnel of 140° C. (284° F.) and higher produce evenly shrink wrapping of all of the above shrink films without any of the attendant problems, however, when the tunnel temperature is lowered to 97° C. (206° F.), the required final smooth, clear finish to a decorative sleeve is poor and un-acceptable though that finish might be acceptable for a low temperature shrinkage film generally used around around meat/cheese. At 100° C. (212° F.) barely acceptable results were achieved but only on a few products or containers. Similarly it has been found by the inventor that by employing solely radiant heaters, such as infrared or other heating elements alone that temperatures in the range of 425 to 500° F. are necessary to shrink these sleeves 14, 25, but usually accompanied by some or all of the following unsatisfactory results of uneven shrinking, wrinkling, burning at the edges, blisters and bubbles.

Referring again to FIG. 1, steam tunnel 10, heat-shrinking zone 27 is disposed between first steam tunnel entrance opening 11 and steam tunnel exit opening 12 and between steam manifolds 30. Second heat source, preferably a plurality of vertically spaced apart heating elements 19, are disposed adjacent steam manifolds 30, heating elements 19 generally extending parallel to conveyor 15 between ends 11 and 12 of steam tunnel 10. Steam manifolds 30 also comprise contiguous sections comprising first steam discharge zones 32*a*, 32*b* and second steam discharge zones 33*a*, 33*b*. First steam discharge zones 32*a*, 32*b* lie substantially parallel to and adjacent to conveyor 15 and are spaced just above a top surface of conveyor 15. First steam discharge zones 32*a*, 32*b* are used to initiate shrinkage of thermo-shrinkable material 14 around a base of container 13 to anchor thermo-shrinkable sleeve 14 thereto. Second steam discharge zones 33*a*, 33*b* are inclined relative to conveyor 15, second steam discharge zones 33*a*, 33*b* generally parallel to a transport axis 35 of conveyor 15, however, second steam discharge zones 33*a*, 33*b* may converge to a central position directly above a center of transport conveyor 15. Second steam discharge zones 33*a*, 33*b* create a longitudinally disposed, vertically rising temperature profile along axis 35 of conveyor 15 to ensure that thermo-shrinkable sleeve 14 is shrunk around all portions of container 13 by controlling shrinkage of thermo-shrinkable sleeve 14 in a vertical fashion above conveyor 15. Nozzles 31 in second steam discharge zones 33*a*, 33*b* admit steam at intervals spaced both vertically from conveyor 15 and horizontally along conveyor axis 35 so that a progressive shrinking of thermo-shrinkable sleeve 14 from a base thereof resting on conveyor 15 to an end opposite the base so that undesirable effects of thermal shrinking, including, but not limited to, trapped air bubbles, wrinkling, whitening, uneven shrinkage, shrinkage shading, crinkling and/or deformation are substantially eliminated. Nozzles 31 of second steam discharge zones 33*a*, 33*b* extend at least above a top of steam tunnel entrance opening 11 to accommodate product or product containers of that height. By providing progressive shrinking of thermo-shrinkable sleeves 14 vertically above and horizontally along conveyor 15, the total length of steam tunnel 10 is reduced. Alternately the disposition of the electrical heating elements 19, and/or the steam manifolds 30 can be varied in position and/or sizing to suit individual circumstances. Typically, prior art steam tunnels are six to ten feet in length, whereas steam tunnel 10 of this invention is generally from about two to about four feet in length. Though container 13 is generally shown as a pyramidal shape, steam tunnel 10 is effective in shrinking thermo-shrinkable sleeves 14 about a variety of container shapes and sizes and has alternately been used to shrink thermo-shrinkable sleeves 14 around flat card stock suspended on racks carried by conveyor 15. At least one container 13*a*, featuring pre-applied thermo-shrinkable body 14 is placed upon transport conveyor 15, transport conveyor 15 acting to transport container 13*a*, carrying pre-applied thermo-shrinkable body sleeve 14 therearound, into first steam tunnel entrance opening 11, through heat-shrinking zone 27, with container 13*b* carrying shrunk thermo-shrinkable sleeve 14 thereto out steam tunnel exit opening 12. Steam generator 23, generating steam at a preferred temperature, passes the steam, under pressure through steam outlet 16 of steam generator 23 through flexible supply pipe 17 to steam inlet connection 18 of steam tunnel 10. It is readily apparent that pre-applied thermo-shrinkable sleeve 14 disposed around container 13*a*, is able to absorb heat energy from steam 29 to shrink pre-applied thermo-shrinkable body sleeve 14 progressively upwardly to container 13*a* so as not to trap air inside sleeve 14 as steam 29 is first introduced as superheated steam through nozzles 31 of steam manifolds 30 and is maintained at or above the temperature of condensation for as long as possible by one or more electric heating elements 19, disposed in a preferred arrangement within steam tunnel 10 thus creating substantially dry heat, within steam tunnel 10. Dry heat, maintained by electrical heating elements 19 delays the loss of the preferred-characteristic, relatively higher thermal mass heat energy content of steam 29, preferably superheated steam to ambient environment 22. Container 13*b*, having exited second steam tunnel opening 12 now carries post-shrunk thermo-shrinkable sleeve 24 thereupon. Pliable curtain segments 21 are disposed over first steam tunnel opening 11, and on second steam tunnel opening 12, curtain segments 21 acting to slow loss of heat energy within steam tunnel 10, to ambient environment 22 through openings 11, 12.

Figure 2:
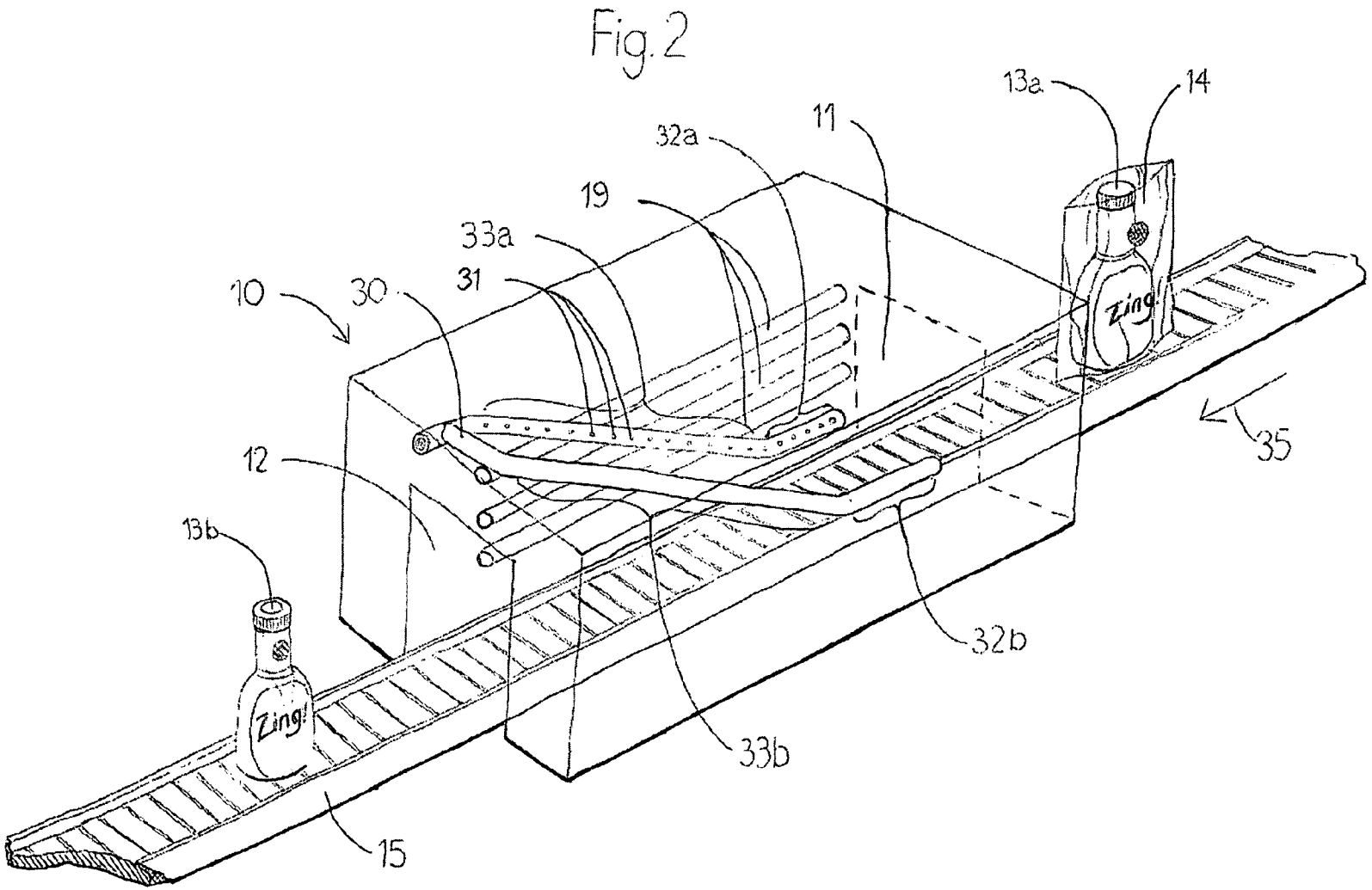
FIG. 2 illustrates a schematic perspective view of the general interior of the device in accordance with the present invention.

FIG. 2 illustrates a preferred configuration of steam discharge manifold 30, featuring a preferred pattern of steam discharge orifices 31 arranged horizontally in steam discharge zone 32*a*, 32*b* and angled upwardly in second steam discharge zone 33*a*, 33*b*. Electric heating elements 19 disposed on either interior side of steam tunnel 10 between the interior side walls and steam discharge manifold 30, are arranged substantially parallel with conveyor transport axis 35 and spaced thereabove. Preferably, at least two electric heating elements 19 are disposed on either side of conveyor 15, one electric heating element 19 spaced vertically above another electric heating element 19. As shown in FIG. 2, the instant invention employs three electric heating elements 19 behind each leg of steam manifold 30, each electric heating element 19 spaced vertically above a lower electric heating element 19. By employing electric heating elements 19 in vertically spaced relationship, the quality of steam admitted by nozzles 31 is retained for a period of time sufficient to fully and progressively shrink thermo-shrinkable sleeve 14 around container 13. First steam discharge zone 32*a*, 32*b* purposefully and initially acting to shrink and anchor a lower portion of pre-applied thermo-shrinkable body sleeve 14 to container 13*a*, after container 13*a* enters steam tunnel 10 through first steam tunnel opening 11. Second steam discharge zone 33*a*, 33*b*, angled with respect to container transport axis 35, produces a steam discharge profile generally rising in position with respect to transport conveyor 15 as container 13*a* carrying pre-applied thermo-shrinkable body sleeve 14 progresses through shrinking zone, second steam discharge zone 33*a*, 33*b* acting to shrink pre-applied thermo-shrinkable body sleeve 14 progressively upwardly so as not to trap air inside sleeve 14 around container 13 through shrinking zone.

Figure 3:
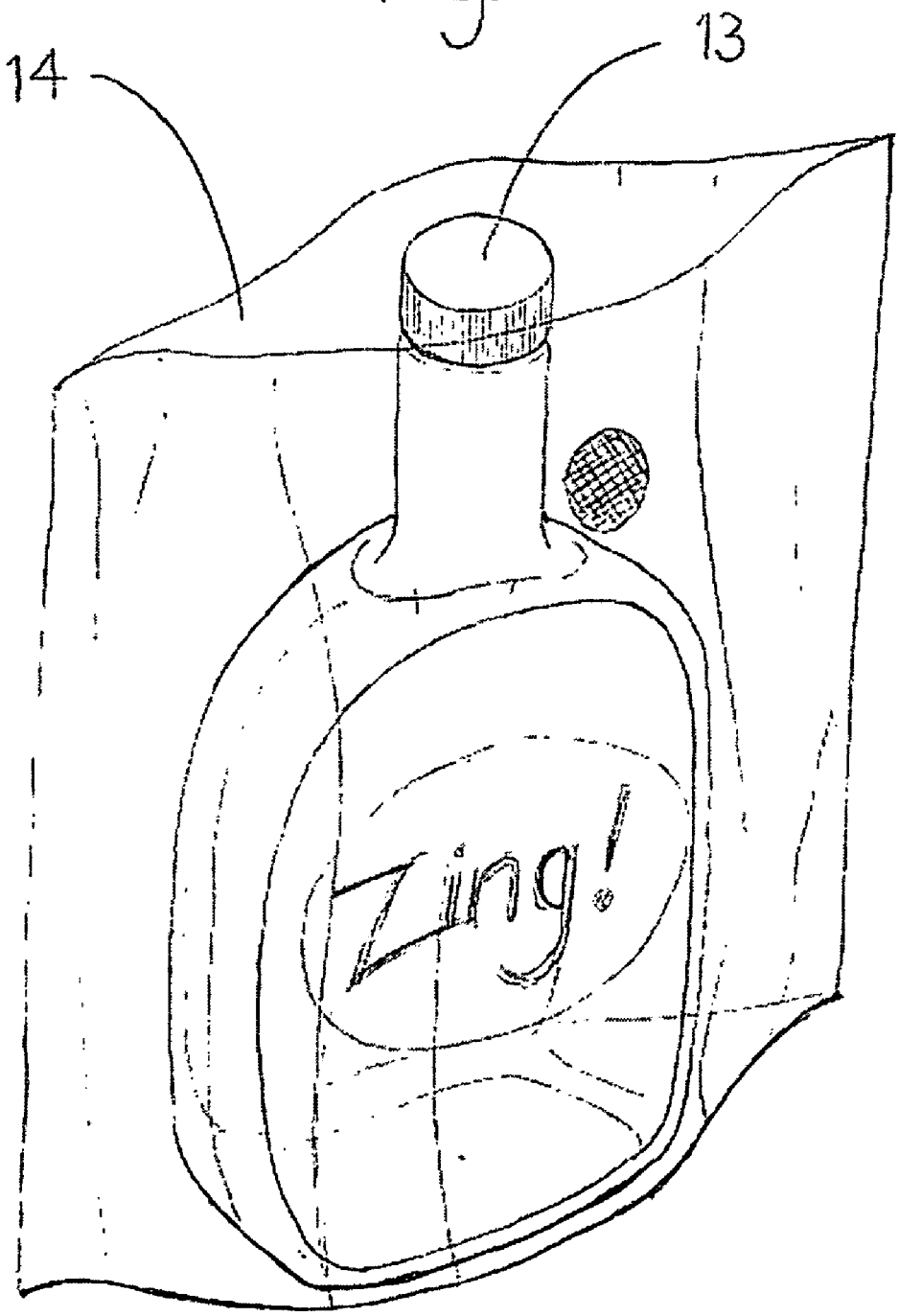
FIG. 3 illustrates a schematic perspective view of a pre-applied thermo-shrinkable body sleeve on a container.

FIG. 3 illustrates a schematic perspective view of container 13 featuring a pre-applied thermo-shrinkable body sleeve 14 disposed therearound prior to entrance into steam tunnel 10. Though thermo-shrinkable body sleeve 14 appears to have two oppositely disposed seams, it is to be fully understood that thermo-shrinkable body sleeves 14 may be extruded cylindrical sleeves or polygonal sleeves as are employed in the field. Thermo-shrinkable sleeves 14 may also have any variety of pre-printed material thereupon wherein the pre-printed material may include graphic data, human readable data or machine readable data.

Figure 4:
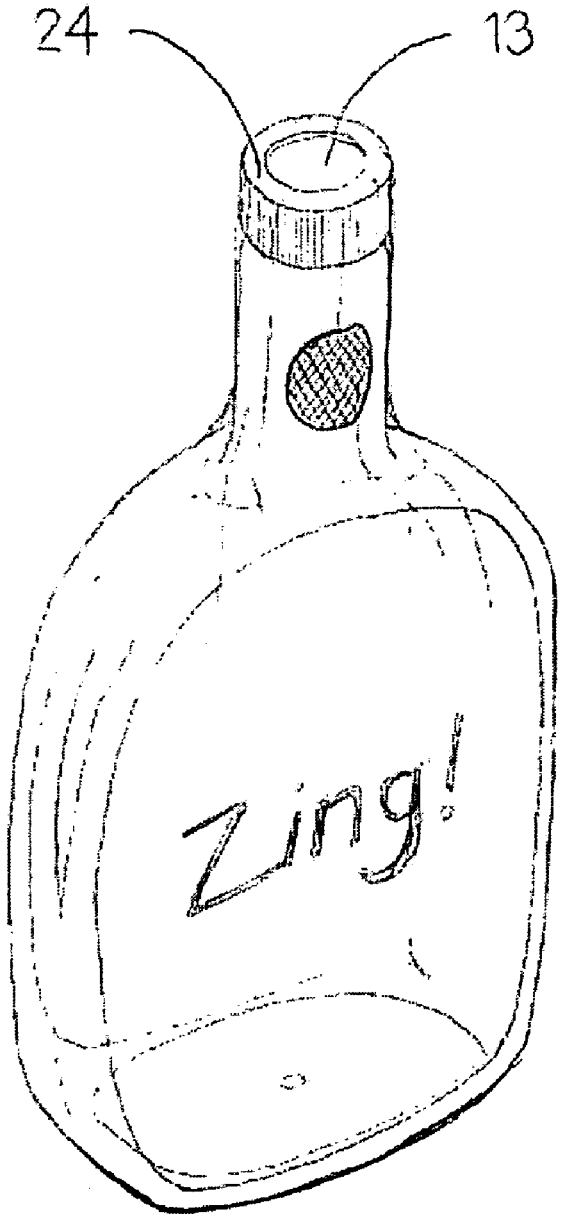
FIG. 4 illustrates a schematic perspective view featuring a post-shrunk thermo-shrinkable body sleeve on a container.

FIG. 4 illustrates a schematic perspective view of container 13 featuring a post-shrunk thermo-shrinkable body sleeve 24 fully compliant with the shape of container 13. It is to be fully understood that though a product container has been illustrated in the drawings and discussed in the narrative, that actual product, such as card stock, boxes or multiple containers grouped together under a single thermo-shrinkable sleeve 14 may be passed through steam tunnel 10 without damage to the product.

Figure 5:
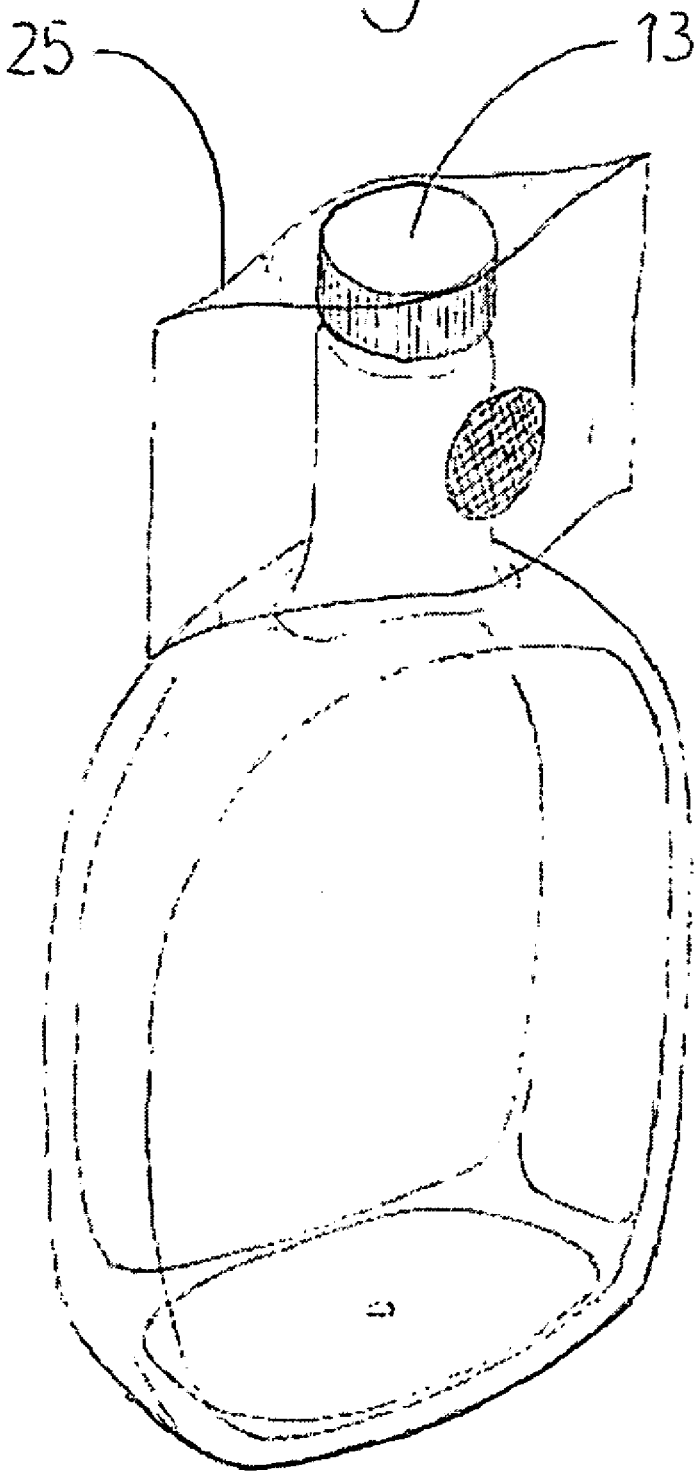
FIG. 5 illustrates a schematic perspective view featuring a pre-applied thermo-shrinkable neck sleeve on a container.

FIG. 5 illustrates a schematic perspective view of container 13 featuring a pre-applied neck sleeve 25 disposed only around a neck of container 13. Neck sleeve 25 may also be tubular or polygonal and may also carry pre-printed material including graphic data, human readable data or machine readable data.

Figure 6:
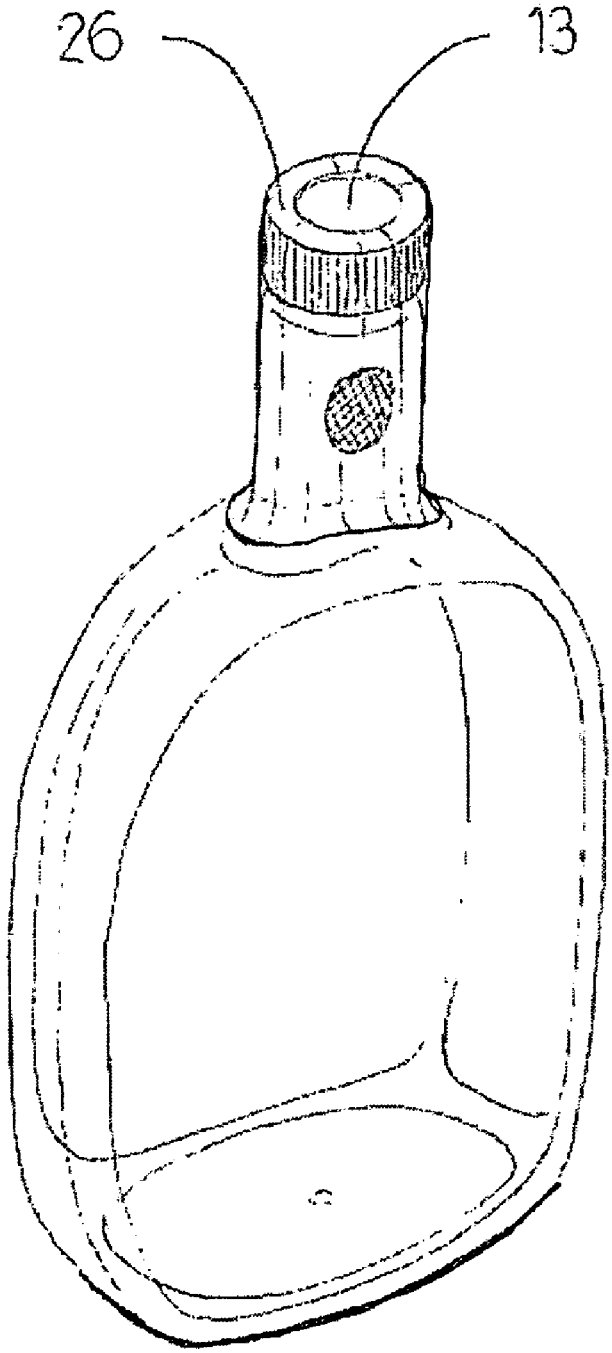
FIG. 6 illustrates a schematic perspective view featuring a post-shrunk thermo-shrinkable neck sleeve on a container.

FIG. 6 illustrates a schematic perspective view of container 13 featuring a post-shrunk neck sleeve 26 which is now fully compliant with the shape of the neck of container 13.

The geometries and actual position of the steam discharge manifold 30 and the electrical heating elements 19, are illustrated solely by way of example as it is understood that varying steam manifold geometries, varying steam discharge orifice geometries, varying steam discharge orifice patterns, varying steam discharge orifice quantities, varying steam discharge orifice diameters and varying steam discharge orifice locations, varying electrical heating element 19 position and quantity among other variable steam tunnel parameters may be required in varying combinations and permutations related to varying container geometries and varying sleeve materials. For instance, it is fully within the scope of this invention to preheat the air in the heat processing zone with electric elements such as a Leister gun to the desired temperature then augment the heat shrinking process with the right amount of steam at a higher temperature, limiting the amount of steam to an amount necessary for proper overall shrinkage. The higher temp steam provides the heat to shrink the thermo-shrinkable sleeve, and therefore by limiting the amount of steam to what is necessary for shrinkage may result in lower energy consumption, especially when compared to shrinkage by just heated air. By providing enough heat energy to effect proper shrinkage of thermo-shrinkable sleeves 14 by keeping the temp higher, a lot of condensate and dripping of condensed water in an environment that does not like water is avoided. This is particularly important when heat shrinking thermo-shrinkable materials 14 around packages of pharmaceuticals, cosmetics, powders, etc. Also, by reducing the amount of water, ruining of pre-labeled bottles can be from excessive water can be avoided.

It is not to be inferred that the present patent is limited to the shrinking of thermo-plastic sleeves which were used simply for purposes of illustration. Other uses of the present invention may be apparent to those skilled in related arts.

The above descriptions of a preferred embodiment should not be interpreted in any limiting manner as refinements and variations can be made without departing from the spirit of the invention.

The scope of the invention is defined in the appended claims and their equivalents.

I claim:

1. An elongated steam-heated processing zone comprising a first type heat source steam entering said heated processing zone by means of at least one steam discharge opening disposed substantially within said steam-heated processing zone, at least one second type heat source, other than steam disposed within said steam heated processing zone; said second type heat source substantially and advantageously retarding decay of one or more preferred heating characteristics of said first type heat source, said first heat source further comprising at least one steam manifold inclined vertically relative to and axially alongside a conveyor passing through said heated processing zone, said steam manifold admitting steam through a plurality of steam discharge nozzles into said elongated heated processing zone, said plurality of steam nozzles progressively heating a thermo-shrinkable material disposed around an object carried by said conveyor as said object progresses along said conveyor where said second type heat source comprises a plurality of variably controlled temperature heating devices where said heating devices of said second heat source in said steam-heated processing zone are selected from the group consisting of infrared heaters, electrical strip heaters, radiant heaters, hot air blowers, high frequency electromagnetic devices, high frequency sonic discharge devices and combinations of the above where said first type heat energy source steam, is in cooperative communication with at least said second type heat energy source wherein said second energy source augments said temperature of said first heat energy source, said second energy source disposed at spaced intervals above said conveyor, said augmentation drying said steam from said first energy source.

2. An elongated steam-heated tunnel comprising a first type heat source entering said heated tunnel through a plurality of steam manifolds disposed substantially within said steam-heated tunnel, at least one second type heat source, other than steam disposed within said steam heated tunnel, a first portion of said plurality of steam manifolds lying adjacent to and parallel with a conveyor passing through said heated tunnel and a second portion of said plurality of steam manifolds inclined relative to and parallel with said conveyor, said first portion of said steam manifolds shrinking a lower portion of a thermo-shrinkable material about a lower portion of a product carried by said conveyor and said second portion of said steam manifolds progressively shrinking a remainder of said thermo-shrinkable material about said product as said product progresses through said heated tunnel.

3. A device as described in claim 2 where said steam manifolds of said steam-heated processing zone are provided with a plurality of steam discharge orifices.

4. A device as described in claim 2 where said manifolds of said steam-heated processing zone have at least one orifice disposed adjacent terminal ends thereof.

5. A device as described in claim 4 where said terminal ends are disposed parallel to said conveyor and parallel to said axis of said conveyor, said terminal end establishing a first steam discharge zone.

6. A device as described in claim 5 where said plurality of orifices are disposed in vertical spaced relationship along said manifolds from said terminal ends to inlet ends thereof, said plurality of orifices establishing a second steam discharge zone.

7. A device as described in claim 6 wherein said second heat source is disposed between a side wall of said heat tunnel and said steam manifolds.

8. A device as described in claim 7 wherein said first heat source is superheated steam supplied by a steam generator disposed externally of said heat tunnel.

9. A device as described in claim 8 wherein heating devices of said second heat source in said steam-heated processing zone are selected from the group consisting of infrared heaters, electrical strip heaters, radiant heaters, hot air blowers, high frequency electromagnetic devices, high frequency sonic discharge devices and combinations of the above.

10. A device as described in claim 9 where said first heat energy source is in cooperative communication with said second heat energy source wherein said second energy source augments said temperature of said first heat energy source, said second energy source disposed at spaced intervals above said conveyor.

11. A device as described in claim 9 where said first heat energy source is in cooperative communication with said second heat energy source wherein said second energy source delays onset of visible water vapor by maintaining said temperature of said first heat energy source.

12. An elongated steam-heated processing zone comprising a first heat source entering said heated processing zone through a plurality of steam manifolds disposed within said steam-heated processing zone, at least one second heat source disposed within said steam heated processing zone, said plurality of steam manifolds comprising a first steam discharge zone and a second steam discharge zone, said first steam discharge zone consisting of terminal ends of said steam manifolds, said first steam discharge zone parallel to a conveyor passing through said elongated steam-heated processing zone, said second steam discharge zone consisting of a portion of said manifolds inclined upwardly from said terminal ends thereof wherein said first steam discharge zone anchoring a heat shrinkable sleeve at a base of a product, said second steam discharge zone shrinking said heat shrinkable sleeve progressively upward around said product and wherein said second heat source delays onset of visible vapor of said first steam discharge zone.

* * * * *